US006354885B1

(12) United States Patent
Bradley et al.

(10) Patent No.: US 6,354,885 B1
(45) Date of Patent: Mar. 12, 2002

(54) GUIDE SYSTEM WITH INTEGRAL KEYING AND ELECTROSTATIC DISCHARGE PATHS FOR SEPARABLE PIN AND SOCKET CONNECTOR SYSTEMS

(75) Inventors: Robert M. Bradley, Oakville; Sondra Morrissey, Watertown, both of CT (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/587,264

(22) Filed: Jun. 5, 2000

(51) Int. Cl.[7] ..... H01R 13/64

(52) U.S. Cl. ..... 439/681; 439/80; 439/101; 439/181; 439/79

(58) Field of Search ..... 439/79, 80, 181, 439/101, 108, 608, 681

(56) References Cited

U.S. PATENT DOCUMENTS

| | | | | | |
|---|---|---|---|---|---|
| 3,085,221 | A | * | 4/1963 | Kelly | 439/681 |
| 4,655,518 | A | * | 4/1987 | Johnson et al. | 439/62 |
| 4,836,791 | A | * | 6/1989 | Grabbe et al. | 439/108 |
| 4,952,175 | A | * | 8/1990 | Waters et al. | 439/681 |
| 5,215,473 | A | * | 6/1993 | Brunker et al. | 439/108 |
| 5,478,246 | A | | 12/1995 | Cheng | 439/64 |
| 5,549,481 | A | * | 8/1996 | Morlion et al. | 439/108 |
| 5,575,688 | A | | 11/1996 | Crane, Jr. | 439/660 |
| 5,618,191 | A | | 4/1997 | Chikano et al. | 439/108 |
| 5,622,523 | A | | 4/1997 | Kan et al. | 439/607 |
| 5,634,821 | A | | 6/1997 | Crane, Jr. | 439/660 |
| 5,637,019 | A | | 6/1997 | Crane, Jr. et al. | 439/677 |
| 5,980,321 | A | * | 11/1999 | Cohen et al. | 43/108 |
| 5,993,259 | A | | 11/1999 | Stokoe et al. | 439/608 |

FOREIGN PATENT DOCUMENTS

| | | |
|---|---|---|
| DE | 3914978 | 5/1989 |
| EP | 0726477 | 1/1996 |

* cited by examiner

*Primary Examiner*—Tho D. Ta
(74) *Attorney, Agent, or Firm*—Lowe Hauptman Gilman & Berner, LLP

(57) ABSTRACT

The present invention is used in conjunction with two piece connector systems. The present invention provides an integral keying and an electrostatic discharge path. The daughtercard connector has at least two electrostatic discharge paths into an electrostatic discharge contact which then provides a path to a guide pin of the backpanel housing.

15 Claims, 13 Drawing Sheets

GUIDE SYSTEM WITH INTEGRAL KEYING AND ELECTROSTATIC DISCHARGE PATHS FOR SEPARABLE PIN AND SOCKET CONNECTOR SYSTEMS

FIELD OF THE INVENTION

The present invention relates generally to backpanel connectors and daughtercard connectors, and more particularly, to guide systems -including integral keying and having electrostatic discharge paths.

BACKGROUND OF THE INVENTION

Printed circuit boards and devices mounted on printed circuit boards can easily be adversely affected by electrostatic discharge. Connectors such as those disclosed in U.S. application Ser. No. 09/295,344 entitled "HIGH DENSITY ELECTRICAL INTERCONNECT SYSTEM HAVING ENHANCED GROUNDING AND CROSS-TALK REDUCTION CAPABILITY", filed Apr. 21, 1999, U.S. Pat. No. 6,179,663, can store electrostatic energy which is then dissipated onto the printed circuit board when the connectors are mounted thereon. The devices mounted on the printed circuit board can be damaged or otherwise adversely affected. Accordingly, a need exists in the art for a connector which can be used in conjunction with two piece connector systems to dissipate the electrostatic energy.

SUMMARY OF THE INVENTION

It is, therefore, an object of the present invention to provide a backpanel guide assembly and a daughtercard guide assembly having a key and a mating key receptacle to prevent non-matching daughtercard assemblies from mating with the backpanel assembly.

Another object of the present invention is to provide a backpanel guide assembly and a daughtercard guide assembly having a key and mating receptacle which can each be oriented in any one of a number of possible positions, therefore reducing the likelihood of a mating keying insert matching with a non-matching daughtercard assembly.

It is yet another object of the present invention to provide a backpanel guide assembly and a daughtercard guide assembly having mating keys, mating guides and at least one path for electrostatic discharge.

The present invention is used in conjunction with two piece connector systems. The present invention provides integral keying and an electrostatic discharge path. The daughtercard guide assembly has at least two electrostatic discharge paths into an electrostatic discharge contact which then provides a path to a guide pin of the backpanel housing.

These and other objects of the present invention are achieved by a guide module, including a backpanel guide assembly including a backpanel housing and a key oriented in one of a plurality of positions relative to the backpanel housing. A guide pin extends from the backpanel housing. A daughtercard guide assembly includes a mating key receptacle oriented in one of a plurality of possible positions for receiving the key and a guide hole for receiving the guide pin.

The foregoing and other objects of the present invention are achieved by an electrical connector, including a backpanel connector including a backpanel housing having a first electrically conductive pin and a second electrically conductive pin for engagement with a backpanel and a daughtercard connector. A daughtercard housing has a plurality of protrusions and an opening for receiving the guide pin. An electrically conductive post on the daughtercard housing is for engagement with a daughtercard. An electrically conductive stiffener is connected to the protrusions. A contact is mounted to the daughtercard connector for contact with the electrically conductive pin.

The foregoing and other objects of the present invention are achieved by a guide module, including a backpanel guide assembly including a backpanel housing and a key oriented in one of a plurality of possible positions relative to the backpanel housing and an electrically conductive guide pin. A second electrically conductive pin is for engagement with the backpanel. A daughtercard guide assembly includes a mating key receptacle oriented in one of a plurality of possible positions for receiving the key and a guide hole for receiving the guide pin. An opening in the daughtercard housing is for receiving the guide pin. An electrically conductive post is for engagement with a daughtercard. An electrically conductive stiffener is connected to the protrusion. A contact is mounted to the daughtercard guide assembly for contact with the electrically conductive pin.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
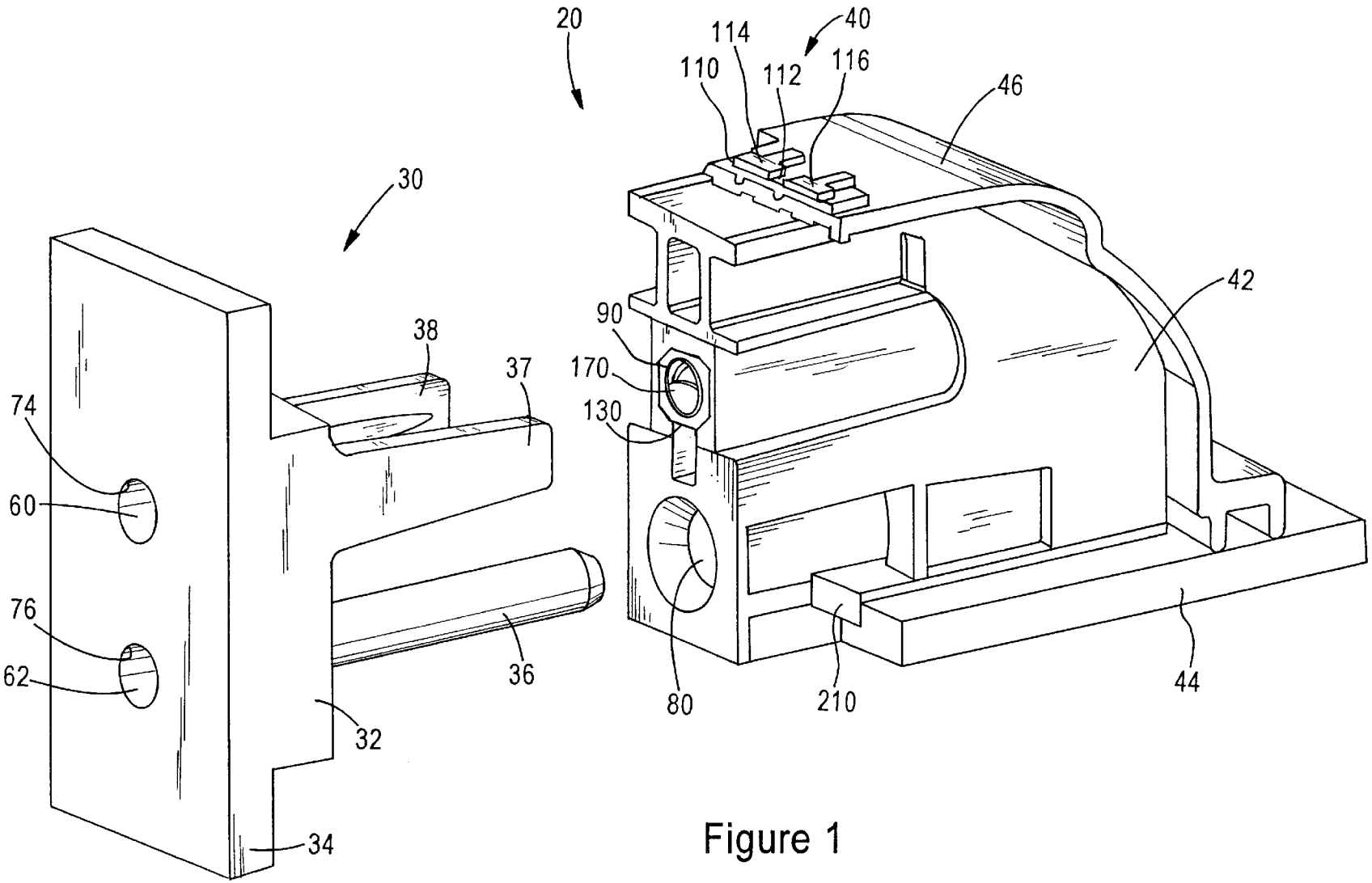
FIG. 1 is a perspective view of a backpanel guide assembly and a daughtercard guide assembly according to the present invention.
Figure 2:
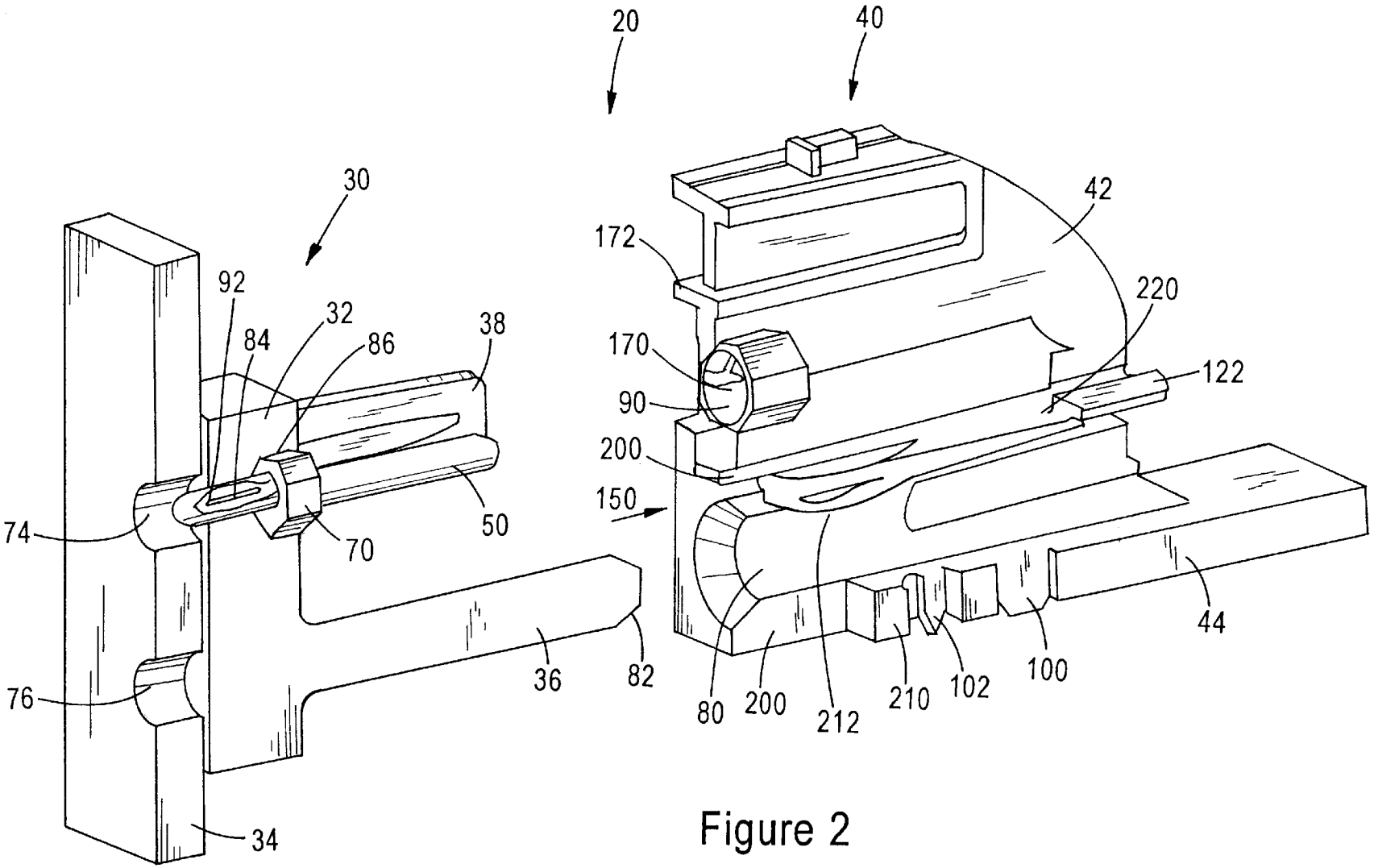
FIG. 2 is a view similar to FIG. 1 with the backpanel guide assembly and daughtercard guide assembly shown partially in cross-section.

Referring first to FIGS. 1 and 2, a set of mating guide modules generally depicted at 20, is depicted according to the present invention. As illustrated in FIGS. 1 and 2, the guide modules 20 are illustrated in a horizontal position although it should be understood that the guide modules 20 are usable in any orientation and accordingly, terms such as "left", "right", "above" and "below" are to be construed in the relative sense.

The guide modules 20 include a backpanel guide assembly 30 and a daughtercard assembly 40. Although a backpanel and a daughtercard are described herein for illustrative purposes, it should be understood that the present invention is applicable to any type of printed circuit board. These guide assemblies 30, 40 can be incorporated into any two piece connector system such as that disclosed in U.S. application Ser. No. 09/295,344, entitled "HIGH DENSITY ELECTRICAL INTERCONNECT SYSTEM HAVING ENHANCED GROUNDING AND CROSS-TALK REDUCTION CAPABILITY", filed Apr. 21, 1999, U.S. Pat. No. 6,179,663, which is assigned to the instant assignee and is hereby incorporated by reference into this specification in its entirety.

Figure 4A:
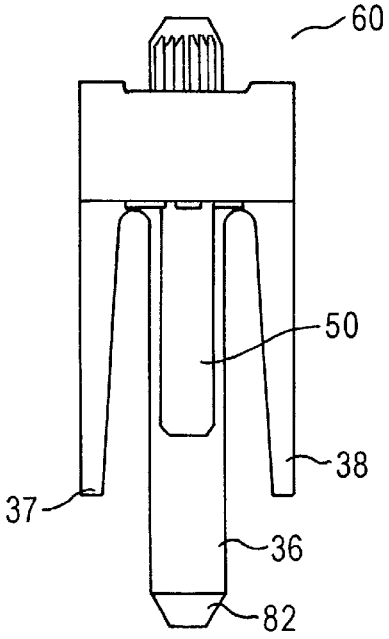
FIGS. 4A, 4B and 4C are top, front and right elevational views of the backpanel guide assembly according to the present invention.
Figure 4B:
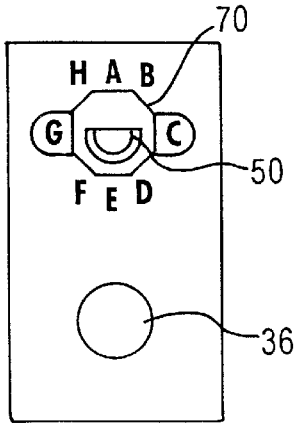

As depicted in FIG. 1, the backpanel guide assembly 30 includes a backpanel housing 32 which is mounted to a backpanel such as a printed circuit board (PCB) 34. Extending forwardly from the backpanel housing 32 is a cylindrical guide pin 36. On opposite sides of a key 50 (FIG. 2) are protective wings 37 and 38 which prevent the key 50 from being damaged or dislodged during the assembly process (see also FIG. 4A). As depicted in FIG. 4B, the key 50 has a D-shaped cross-section. The shape of the key 50 contributes to the ability of the guide system 20 to prevent non-matching daughtercard guide assemblies 40 from mating with the backpanel guide assembly 30.

As depicted in FIG. 2, an octagonal base 70 mates with an octagonal core 86 in the backpanel housing 32. The combination of the octagonal core in the backpanel housing and the octagonal base allowed the key 50 to be positioned in any one of eight possible positions. Of course, any number of positions is possible. The key 50 mates with a mating keying insert 90 which is in the daughtercard guide assembly 40.

Figure 4C:
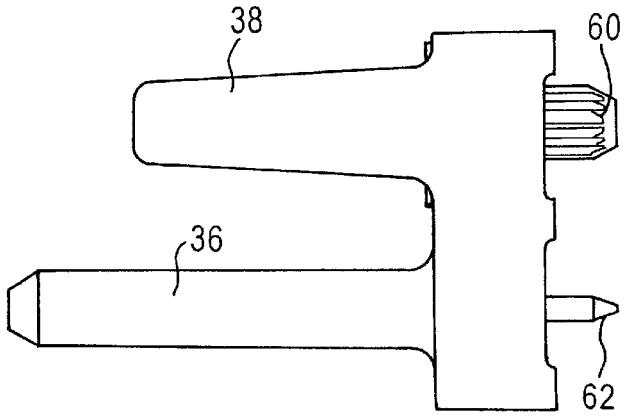
Figure 5:
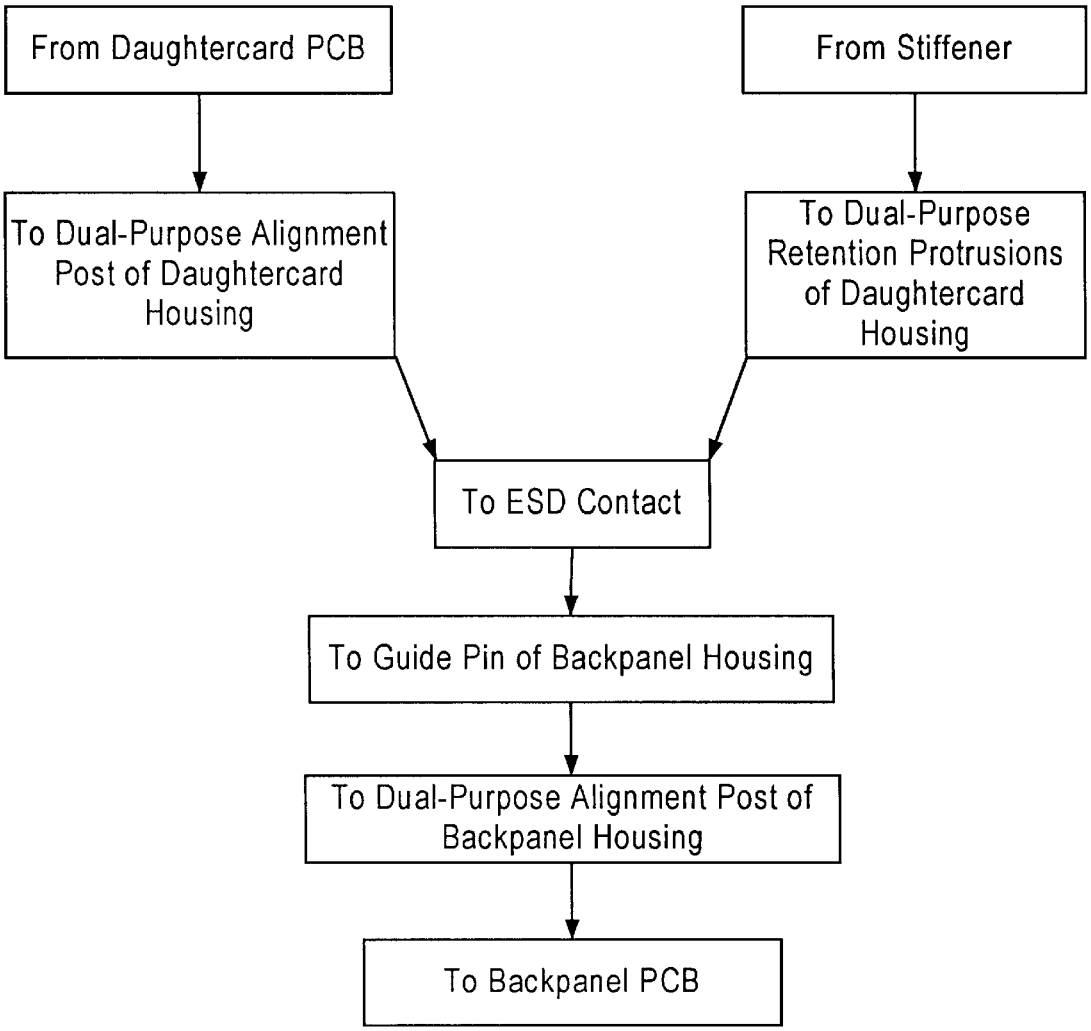
FIG. 5 is a flow diagram of the electrostatic discharge (ESD) path.

As depicted in FIGS. 1 and 4C, there is a dual-purpose retention post 60 extending rearwardly from the backpanel housing 32 and a dual-purpose alignment post 62 also extending rearwardly from the backpanel housing 32. The post 60 is aligned with and coaxial with the key 50. The post 62 is coaxial with and aligned with the guide pin 36. The post 60 both locates the backpanel guide assembly 30 and retains the backpanel guide assembly 30 in the printed circuit board 34. There is an interference fit between the post 60 and the printed circuit board hole 74 which retains the backpanel guide assembly 30. Advantageously, this post 60 eliminates the need to work from the underside of the printed circuit board 34 during installation (e.g., to screw in mounting screws). The post 62 aligns the backpanel guide assembly 30 in the hole 76 and prevents rotation of the backpanel guide assembly 30 relative to the printed circuit board 34. The post 62 has a 2-point contact with the PCB plated through hole 76 which forms an electrical connection along the electrostatic discharge (ESD) paths as will be described in greater detail below. The pin 36 also serves a dual purpose. The guide pin 36 and a mating hole 80 locate the daughtercard assembly 40 relative to the backpanel guide assembly 30. The pin 36 has a cone-shaped tip 82 which improves the guide system's 20 ability to locate the connectors 30, 40. The guide pin 36 is also a component of the electrostatic discharge path.

The backpanel housing 32 has a key retention hole 84 which is used to retain the key 50 using an interference fit. The backpanel housing 32 has an octagonal core 86 aligned with key retention hole 84. The core 86 mates with the octagonal base 70 of the key. These two octagonal shapes clock the key 50 in any one of eight possible positions. Advantageously, the key 50 and mating keying insert 90 prevent non-matching daughtercard guide assemblies 40 from mating with the backpanel guide assembly 30. Letters A through H identify the orientation of the key as depicted in FIG. 4B. The explicit identification simplifies both the assembly process and the subsequent interpretation of the position of the key 50. Incorporation of the letters into the housing 32 saves the cost of an additional marking or labeling operation.

The protective wings 37, 38 prevent the key 50 from being dislodged or damaged. The backpanel housing 32 is a die cast part which provides robustness and strength. The metal material used for the housing allows the housing to function as an electrostatic discharge device.

As depicted in FIG. 2, the key 50 has a rear retention rib section 92 which retains the key 50 in the key retention hole via an interference fit. The octagonal base 70 mates with the octagonal core 86 of the backpanel housing 32. These two shapes clock the key 50 into any one of eight possible positions. The key 50 and the mating keying insert 90 prevent non-matching, daughtercard guide assemblies 40 from mating with the backpanel guide assembly 30.

Figure 3A:
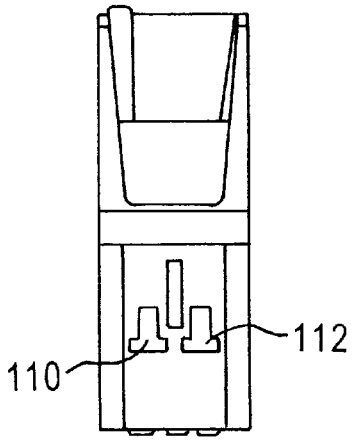
FIGS. 3A, 3B and 3C are top, front and side elevational views of the daughtercard guide assembly according to the present invention.
Figure 3B:
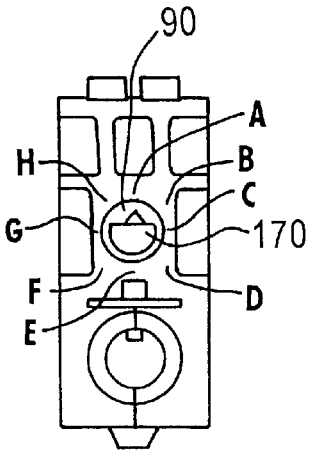
Figure 3C:
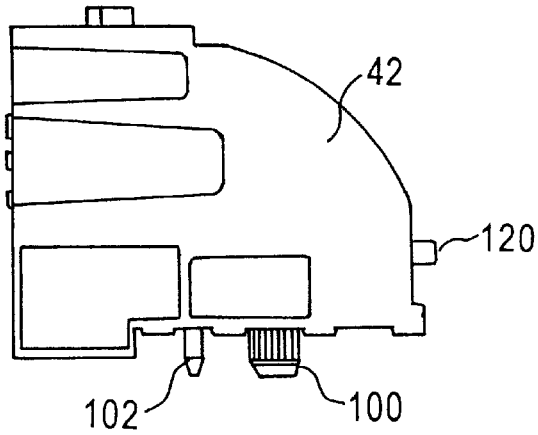

As depicted in FIG. 2, the daughtercard housing 42 includes a downwardly extending dual-purpose retention post 100 (see FIG. 3C). This post 100 both locates the guide assembly 40 and retains it in the printed circuit board 44. The interference between the post 100 and the PCB hole retains the daughtercard guide assembly 40. A dual purpose alignment post 102 extends downwardly from the daughtercard housing 42. This post 102 (see also FIG. 3C) aligns the daughtercard guide assembly 40 and prevents rotation of the assembly on the printed circuit board 44. The 2-point contact with the printed circuit board through hole is an electrical connection along the electrostatic discharge (ESD) path.

Figure 6:
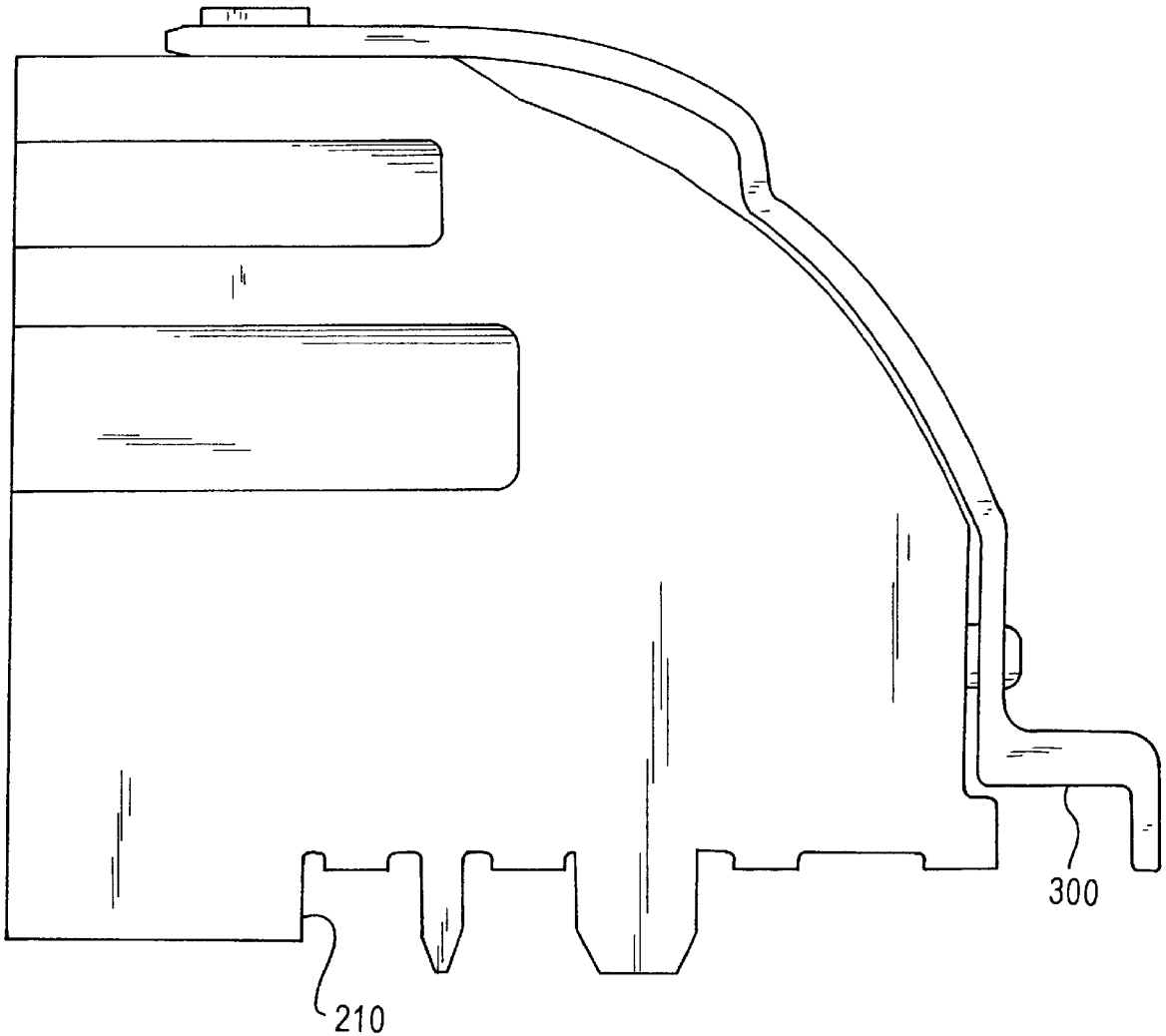
FIG. 6 is a side elevational illustration of a module heel used to align the stiffener;.
Figure 7:
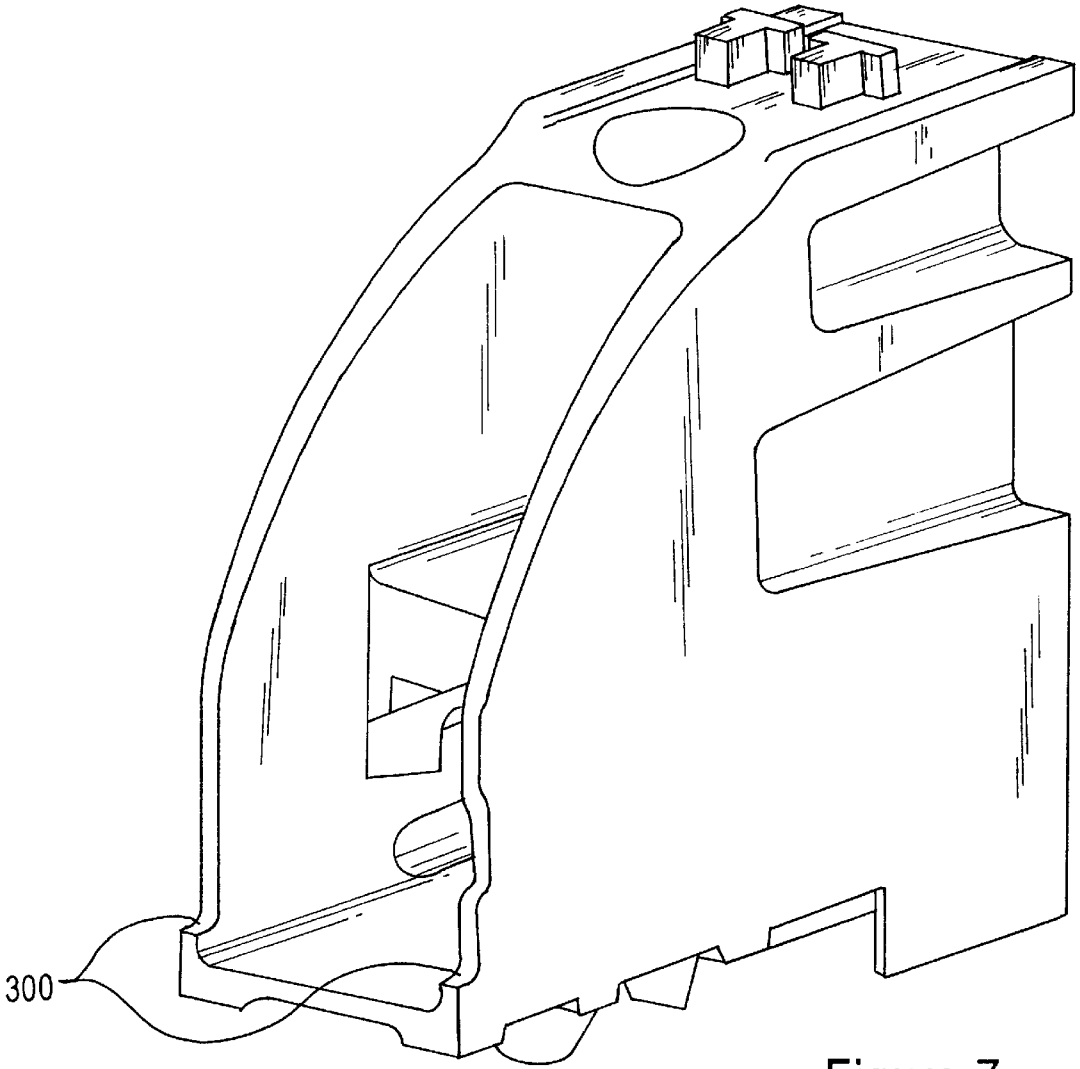
FIG. 7 is a perspective view of the module heel of FIG. 6.
Figure 8:
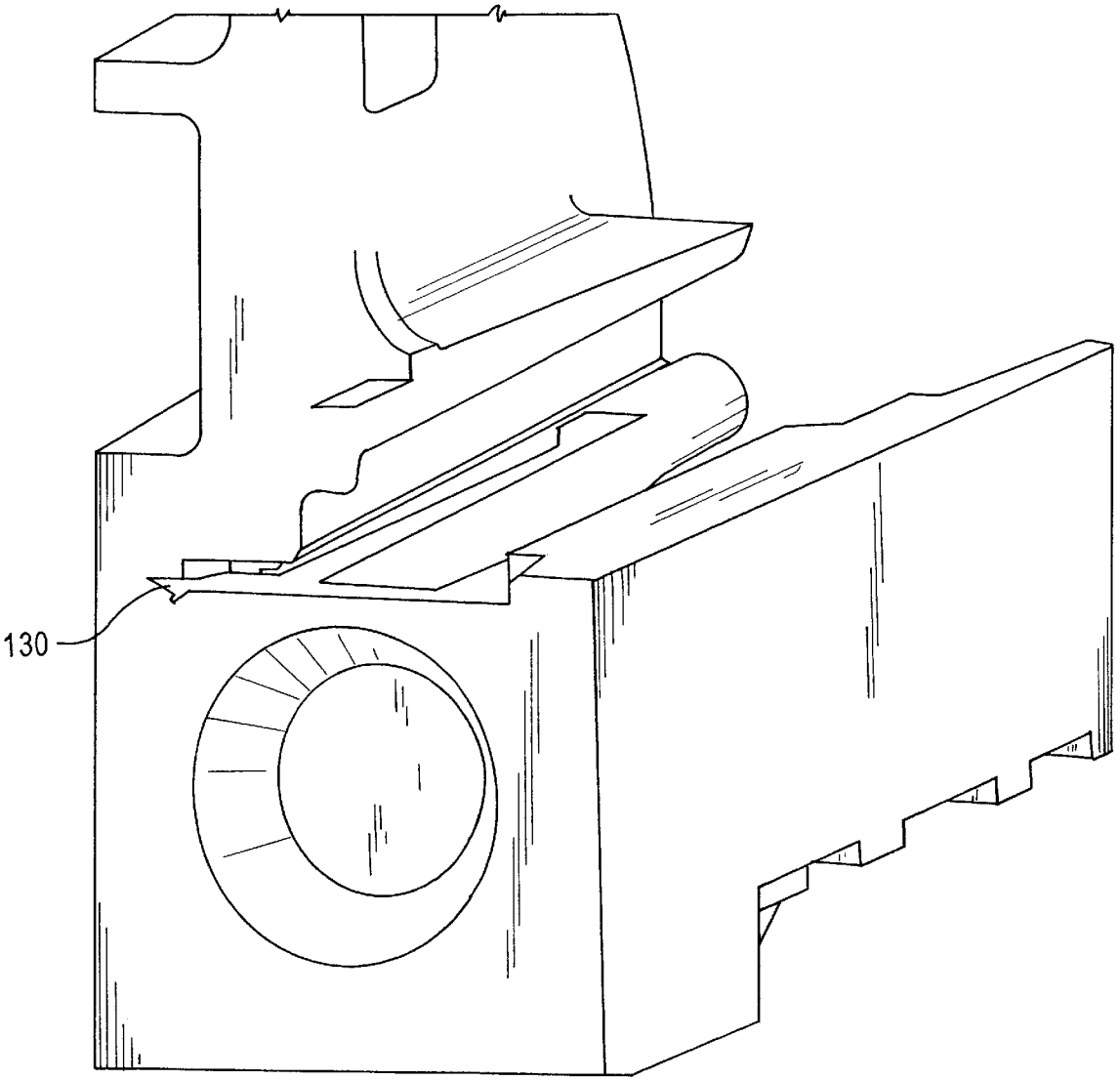
FIG. 8 is a perspective illustration, partially cut away, of an ESD core.
Figure 9:
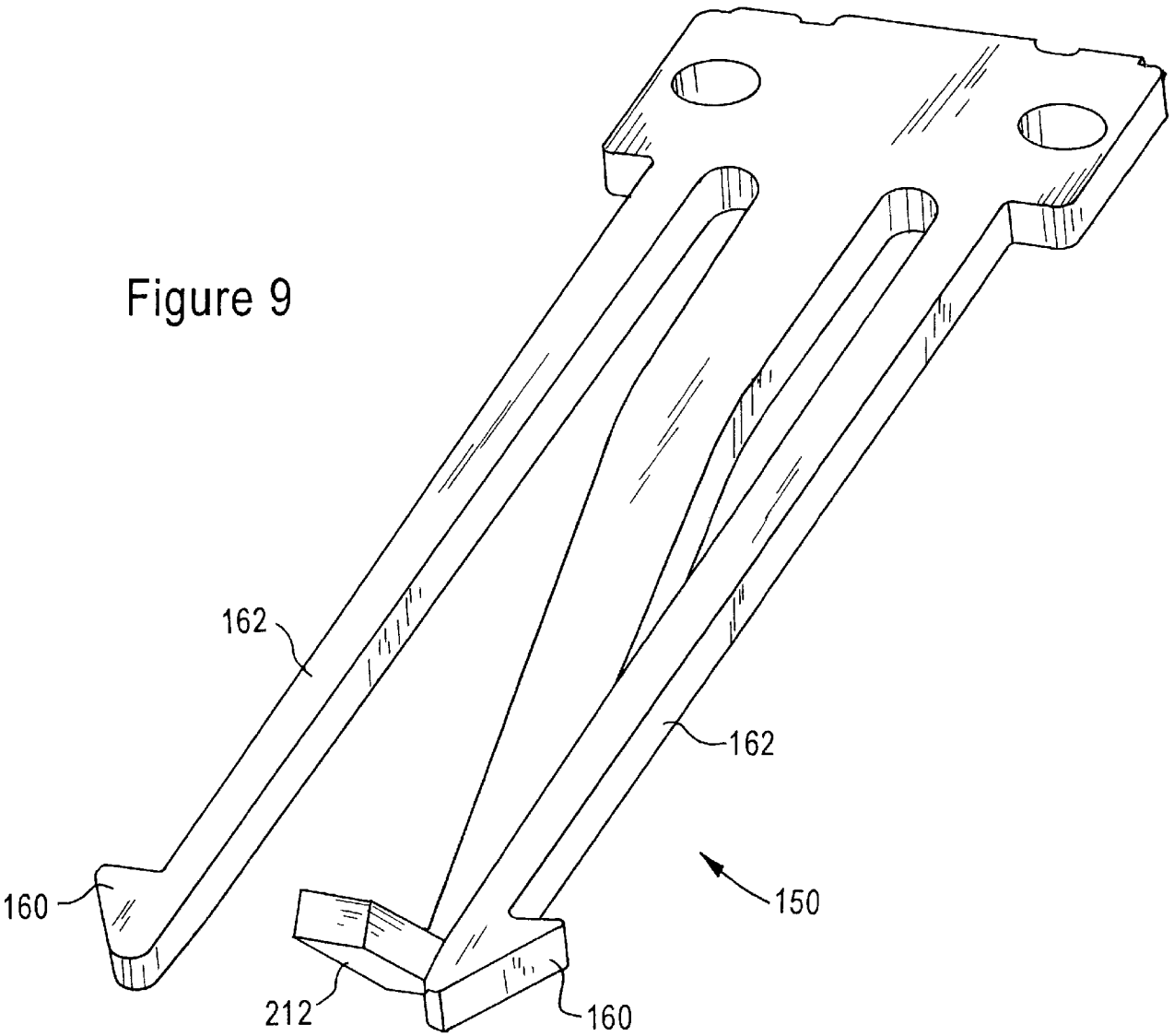
FIG. 9 is a perspective view of an ESD contact.
Figure 10:
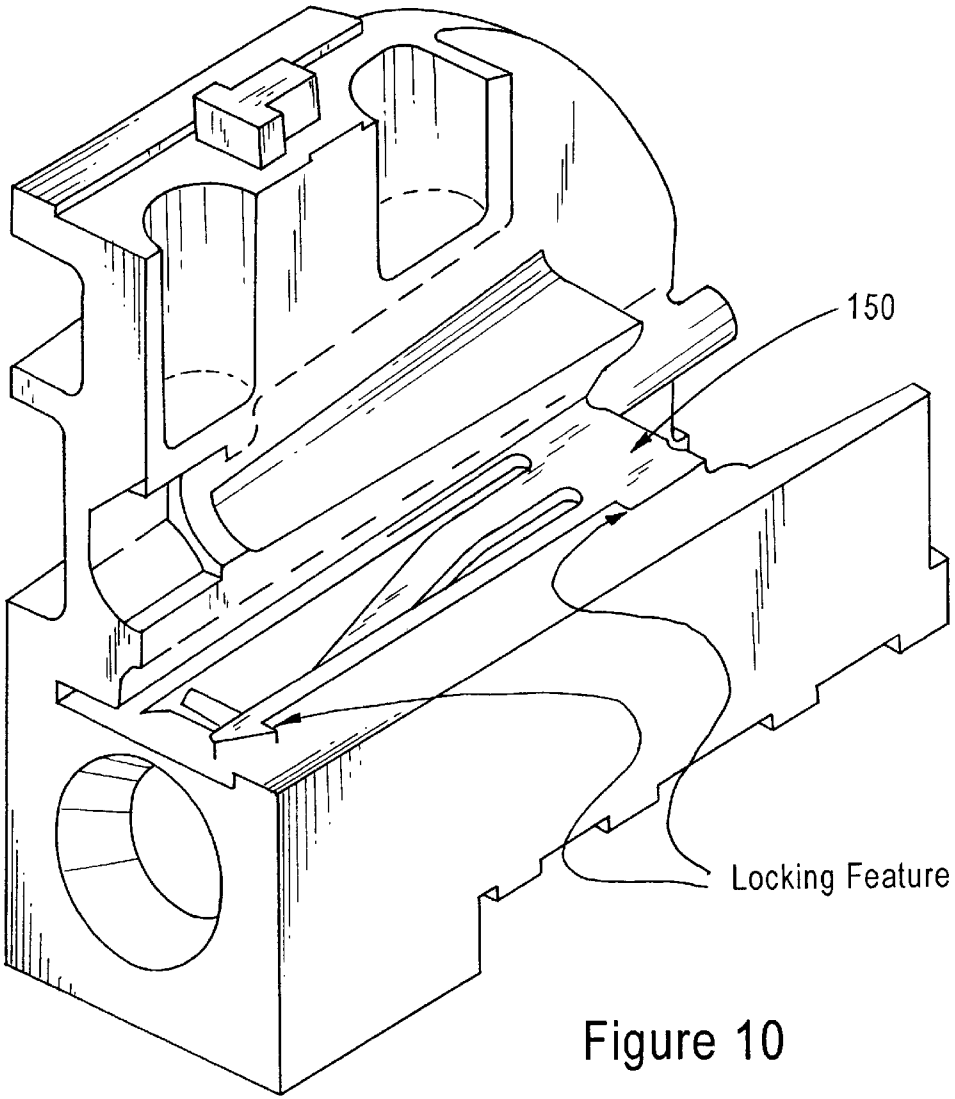
FIG. 10 is a perspective view partially cut away, of the locking feature for locking the ESD contact into the housing.

As depicted in FIGS. 1 and 3A, a plurality of protrusions 110, 112 extend upwardly from the daughtercard housing 42. These protrusions 110, 112 function both mechanically and electrically. Mechanically, the shape of the protrusions 110, 112 and mating stiffener slots 114, 116 in stiffener 46 align the housing 42 relative to other pin and socket connectors such as those disclosed in U.S. application Ser. No. 09/295,344 entitled "HIGH DENSITY ELECTRICAL INTERCONNECT SYSTEM HAVING ENHANCED GROUNDING AND CROSS-TALK REDUCTION CAPABILITY", filed Apr. 21, 1999. The protrusions 110, 112 are then deformed during the assembly process, thereby fastening the daughtercard guide housing 42 to stiffener 46. Electrically the contact between protrusions 110, 112 and the stiffener 46 are connections along the electrostatic discharge path. A cylindrical positioning post 122 extends rearwardly from the housing 42 and locks the daughtercard guide housing 42 into position on the stiffener 46, thereby improving the robustness of the stiffener 46 attachment. The positioning post 122 may also be staked to the stiffener 46 to enhance the retention. The guide hole 80 and mating pin 36 of the backpanel guide assembly 30 locate the daughtercard guide assembly 40 relative to the backpanel guide assembly 30. The keying insert position identification uses letters A through H to identify the orientation of the keying insert (FIG. 3B). The explicit identification simplifies both the assembly process and subsequent interpretation of the position of the insert 90. The incorporation of letters into the housing 42 saves the cost of an additional marking or labeling operation. A shoulder support 210 provides additional support for the daughtercard assembly 40 during the connector mating process. A dual-purpose core 130 (see FIGS. 8, 9 and 10) has both a mechanical function and an electrical function. Mechanically, the core 130 mates with an ESD contact generally indicated at 150, locking it into place and preventing it from dislodging. This occurs due to bending of flexible leg sections 162 and the locking of angled portions 160 into mating sections in the housing 42. Electrically, the interference fit between the core 130 and the contact 150 provides a 2-point connection along the ESD path. A module heel 300 is a protrusion of the housing 42 which sits under the stiffener 46 and fits closely to the stiffener's vertical section to enhance alignment of the housing 42 (see FIGS. 6 and 7). The daughtercard housing 42 is a die cast part which provides strength and robustness. The metal material allows the housing to function for ESD.

As depicted in FIGS. 1 and 2, the key insert 90 has a D-shaped through hole 170 which contributes to the guide system's ability to prevent non-matching daughtercard assemblies from mating with the backpanel assembly. Failure to prevent incorrect mating can disadvantageously result in significant time and cost spent on rework. A positioning arrow 172 for the insert further simplifies the assembly process and subsequent interpretation of the position of the insert 90. The incorporation of the arrow 172 into the insert 90 saves the cost of an additional marking or labeling operation.

As depicted in FIG. 2, a pair of horizontally extending outer beams 200 flex inwardly during the contact assembly 150 into the daughtercard housing 42. When the contact 150 is in place, the beams 200 spring back to their original position, locking the contact 150 in place and preventing the contact 150 from being dislodged during handling and the connector mating process. A compliant center beam 212 extends between the pair of horizontally extending outer beams 200. The compliant center beam 212 is a flexing member that contacts with the guide pin 36 of the backpanel guide assembly 30 when the guide pin 36 is inserted into the mating hole 80. This contact point is a connection along the ESD path. There are two dual-purpose interference bumps 220 as depicted in FIG. 2 which function both mechanically and electrically. Mechanically the interference bumps 220 anchor the ESD contact 150 in the core 130 of the daughtercard housing 42 and help to control the action of the center beam 212. Electrically the interference fit between the bumps 220 and the daughtercard housing core 130 provides a 2-point connection along the ESD path.

The need for the ESD contact 150 is to ensure continuous reliable electrical path for discharge. The system would still serve as an initial electrostatic discharge path without the contact 150. The ESD contact 150 guarantees continuous stable electrical path during operation and since the daughtercard guide housing is attached to stiffener, mechanically and electrically, these items combined also form an EMI shield over the daughtercard signal contact tails.

Figure 11:
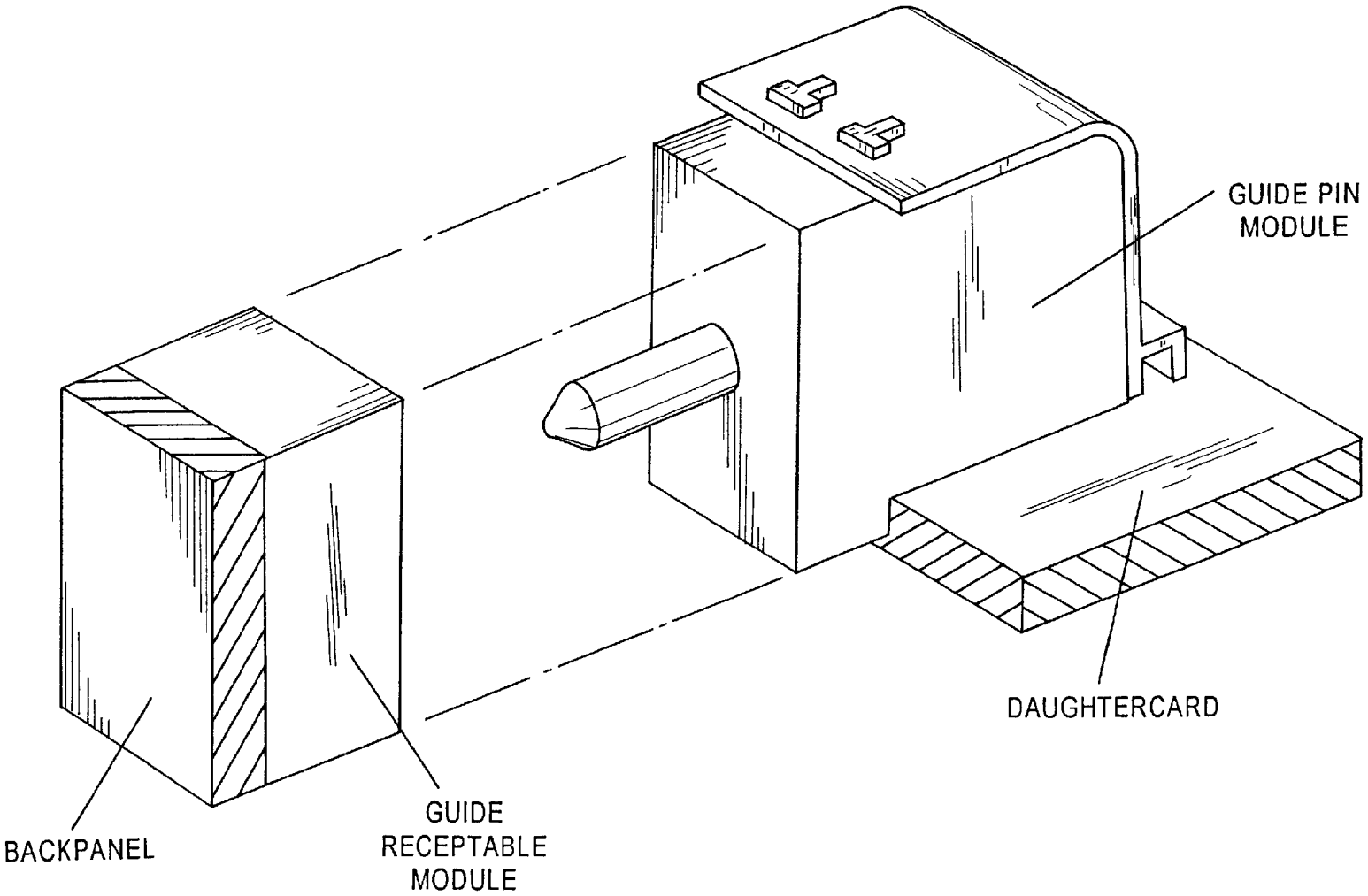
FIGS. 11–13 are alternative embodiments according to the present invention.

FIG. 11 illustrates an alternative reverse gender arrangement where the guide pin module is on the daughtercard and the guide receptacle module is on the backpanel.

Figure 12:
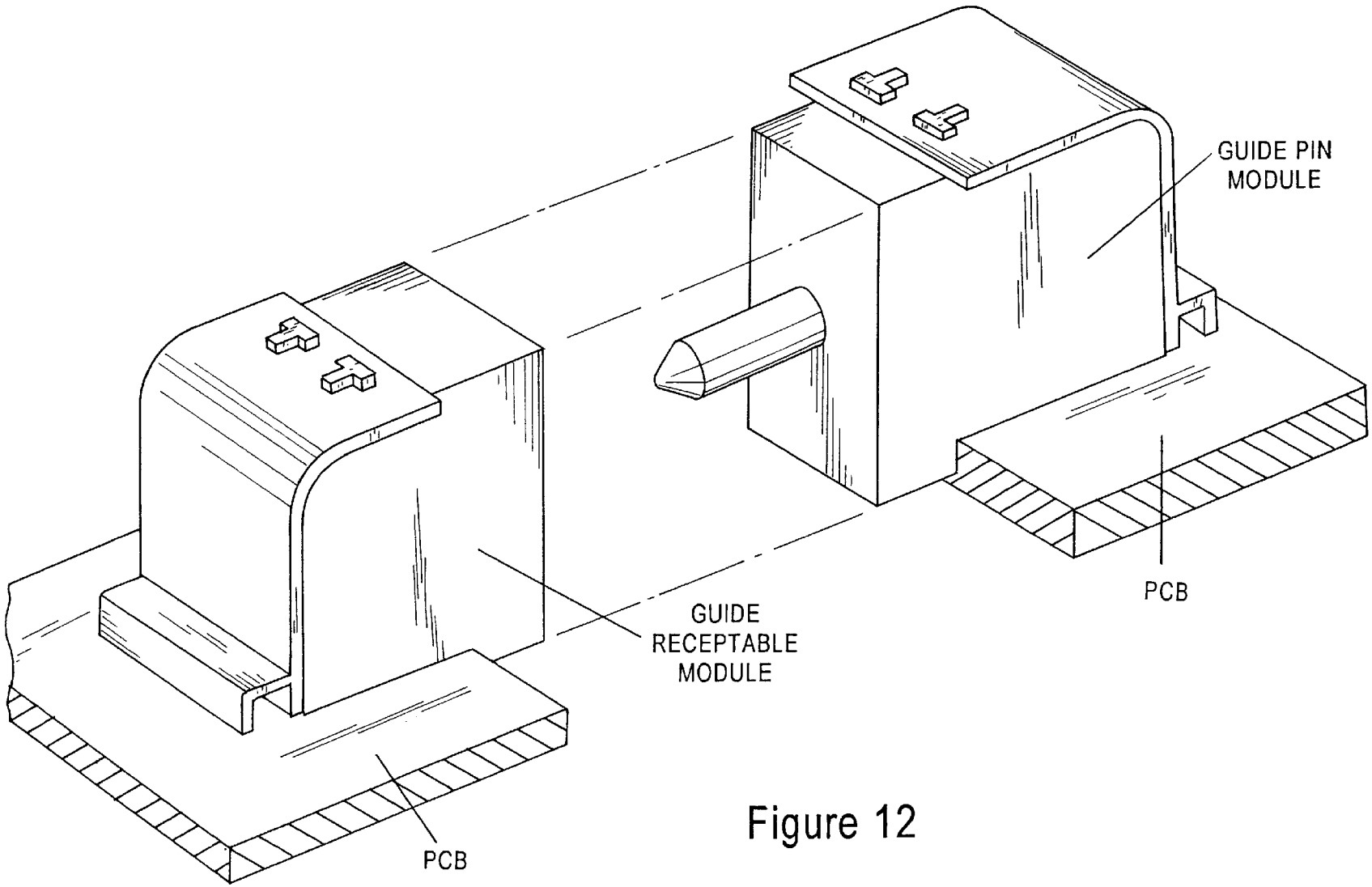

FIG. 12 illustrates another alternative arrangement where two daughtercard connectors (where the printed circuit boards are parallel) in the same plane each require a stiffener.

Figure 13:
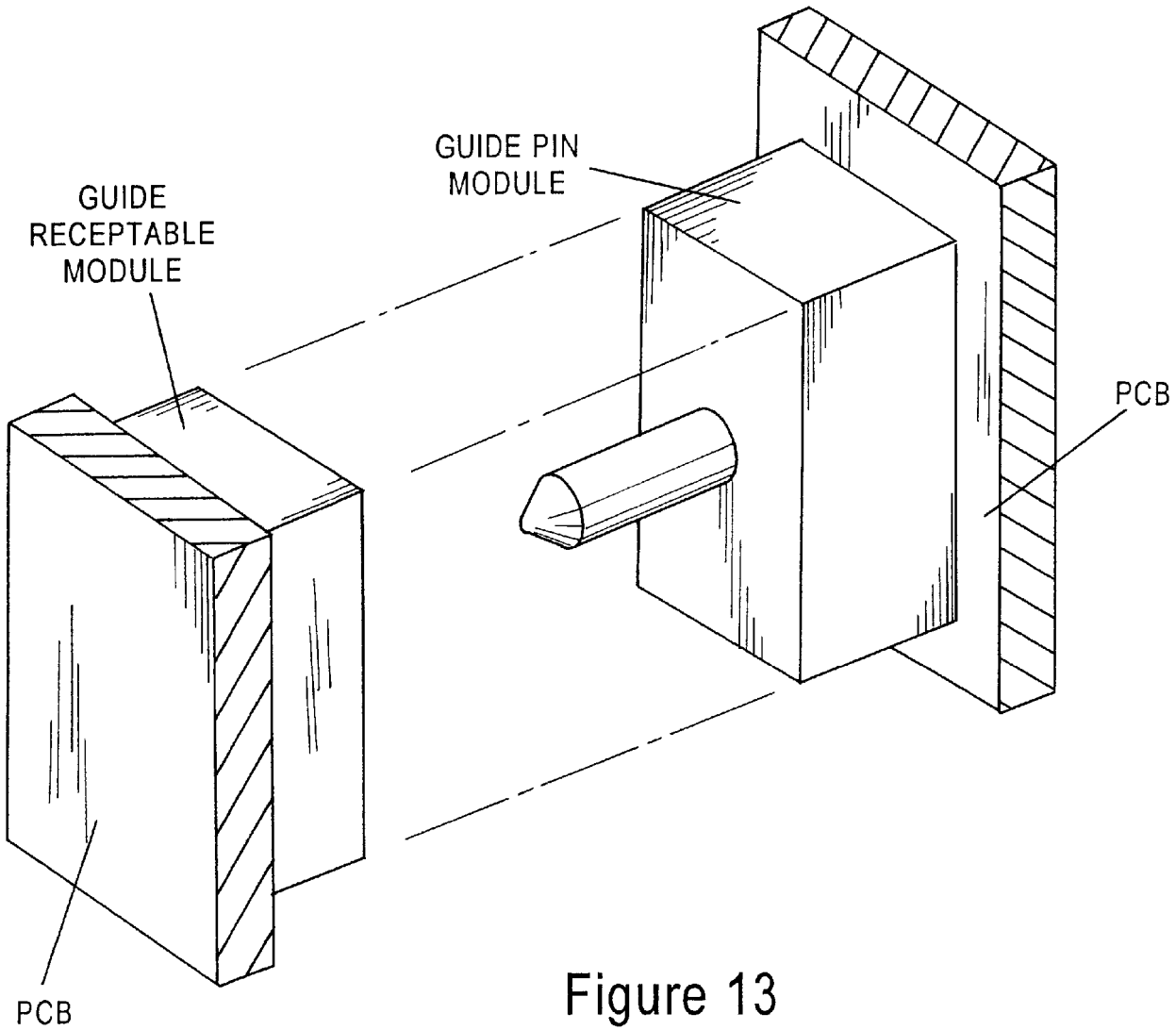

FIG. 13 illustrates yet another alternative arrangement where two backpanel connectors are oriented parallel to each other in different planes.

It should now be apparent that a guide system with integral keying and electrostatic discharge paths for separable pin and socket connector systems has been disclosed. At least two paths have been disclosed through the daughtercard connector to the backpanel connector.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A guide module, comprising:

a backpanel guide assembly including a backpanel housing;

a key oriented relative to said backpanel housing in one of a first plurality of positions;

a first alignment post extending from said backpanel housing for electrical connection with a plated hole in a backpanel; and an electrically conductive guide pin extending from said backpanel housing;

a daughtercard guide assembly including a daughtercard housing, a mating key receptacle oriented relative to said daughtercard housing in one of a second plurality of possible positions corresponding to the first positions for receiving said key;

a second alignment post extending from said daughtercard housing for electrical connection with a plated hole in a daughtercard;

and a guide hole for receiving said guide pin; and a contact mounted to said daughtercard housing for contact with said guide pin;

wherein a first electrostatic discharge path is formed from the daughtercard to said second alignment post to said contact to said guide pin to said first alignment post to the backpanel; and wherein a second electrostatic discharge path is formed from said daughtercard housing to said contact to said guide pin to said first alignment post to the backpanel.

2. The guide module of claim 1, wherein the first alignment post is an end of said guide pin.

3. The guide module of claim 1, wherein a portion of said key has a D-shape cross-section.

4. The guide module of claim 1, further comprising protective wings extending from said backpanel housing and located on opposite sides of said key.

5. The guide module of claim 1, further comprising indicators for identifying the positions of said key and said mating key receptacle.

6. The guide module of claim 1, further comprising a retention post extending downwardly from said daughtercard housing for interference fit with a corresponding hole in the daughtercard.

7. The guide module of claim 1, wherein said backpanel housing includes a multi-sided opening and said key has a multi-sided base corresponding in shape to said multi-sided opening.

8. The guide module of claim 7, wherein said multi-sided opening has an octagonal shape.

9. The guide module of claim 1, further comprising a retention post extending rearwardly from said backpanel housing for interference fit with a corresponding hole in the backpanel.

10. The guide module of claim 9, wherein the retention post is coaxial and aligned with said guide pin.

11. An electrical connector, comprising:

a backpanel connector including a backpanel housing having an electrically conductive guide pin and a first electrically conductive post for engagement with a backpanel; and a daughtercard connector including:

a daughtercard housing having an opening for receiving said guide pin, and a second electrically conductive post for engagement with a daughtercard;

a stiffener connected to said daughtercard housing; and a contact mounted to said daughtercard housing for contact with said electrically conductive guide pin;

wherein a first electrostatic discharge path is formed from the daughtercard to said second electrically conductive post to said contact to said guide pin to said first electrically conductive post to the backpanel; and wherein a second electrostatic discharge path is formed from said stiffener to said contact to said guide pin to said first electrically conductive post to the backpanel.

12. The guide module of claim 11, wherein said contact is formed as a separate piece including a pair of parallel side beams and a central beam, the side beams resiliently mate with a core of said daughtercard housing while the central beam resiliently contacts with said guide pin.

13. The guide module of claim 11, wherein said daughtercard housing has a plurality of protrusions, said stiffener has a plurality of mating slots corresponding to said protrusions, said protrusions are deformable and thus receivable within the mating slots of said stiffener thereby fastening said stiffener to said daughtercard housing.

14. The guide module of claim 15, wherein said stiffener extends circumferentially of said daughtercard housing and has first and second longitudinally spaced end portions, the first end portion is connected to said daughtercard housing via said protrusions, the second end portion is connected to said daughtercard housing via a positioning post extending outwardly from said daughtercard housing.

15. A guide module, comprising a backpanel guide assembly including a backpanel housing, a key oriented in one of a first plurality of possible positions relative to said backpanel housing, an electrically conductive guide pin, and a first electrically conductive post for engagement with a backpanel;

a daughtercard guide assembly including a plurality of protrusions, a mating key receptacle oriented in one of a second plurality of possible positions corresponding to the first positions for receiving said key, a guide hole for receiving said guide pin, and a second electrically conductive post for engagement with a daughtercard;

a stiffener connected to said protrusions; and a contact mounted to said daughtercard guide assembly for contact with said electrically conductive guide pin;

wherein a first electrostatic discharge path is formed from the daughtercard to said second electrically conductive post to said contact to said guide pin to said first electrically conductive post to the backpanel; and wherein a second electrostatic discharge path is formed from said stiffener to said protrusions to said contact to said guide pin to said first electrically conductive post to the backpanel.

* * * * *

UNITED STATES PATENT AND TRADEMARK OFFICE

CERTIFICATE OF CORRECTION

PATENT NO. : 6,354,885 B1 
DATED : March 12, 2002
INVENTOR(S) : Robert M. Bradley and Sandra Morrissey It is certified that error appears in the above-identified patent and that said Letters Patent is hereby corrected as shown below:

Title page,
Item [73], Assignee, please replace "Northrop Grumman Corporation, Los Angeles, CA (US)" with -- Litton Systems, Inc., Woodland Hills, California, (US). --

Signed and Sealed this

Fourth Day of November, 2003

JAMES E. ROGAN
*Director of the United States Patent and Trademark Office*